United States Patent [19]

Nikaido et al.

[11] 3,945,899

[45] Mar. 23, 1976

[54] PROCESS FOR COATING ALUMINUM OR ALUMINUM ALLOY

[75] Inventors: Norio Nikaido; Shinji Shirai; Mototaka Iihashi; Sueo Umemoto, all of Hiratsuka, Japan

[73] Assignees: Kansai Paint Company, Limited; Fuji Sashi Industries Limited, both of Japan

[22] Filed: July 1, 1974

[21] Appl. No.: 484,985

[30] Foreign Application Priority Data

| | | |
|---|---|---|
| July 6, 1973 | Japan | 48-76953 |
| Aug. 3, 1973 | Japan | 48-87279 |
| Nov. 16, 1973 | Japan | 48-128899 |
| Nov. 15, 1973 | Japan | 48-129021 |
| Nov. 15, 1973 | Japan | 48-129024 |
| Nov. 19, 1973 | Japan | 48-129912 |

[52] U.S. Cl. ..... 204/181; 148/6.15 R; 148/6.2; 148/6.3; 148/31.5; 204/38 A; 204/58; 428/469; 428/13

[51] Int. Cl.[2] C25D 5/00; C25D 13/06; C25D 13/20

[58] Field of Search ..... 204/35 N, 38 A, 38 E, 58, 204/181

[56] References Cited

UNITED STATES PATENTS

| | | | |
|---|---|---|---|
| 1,068,410 | 7/1913 | Chubb | 204/58 |
| 1,850,298 | 3/1932 | Washington, Jr. | 204/58 |
| 2,116,449 | 5/1938 | Robinson | 204/58 |
| 2,859,148 | 11/1958 | Altenpohl | 148/6.14 |
| 2,868,702 | 1/1959 | Brennan | 204/28 |
| 2,981,647 | 4/1961 | Schwartz | 148/6.14 |
| 3,622,473 | 11/1971 | Ohta et al. | 204/181 |
| 3,775,266 | 11/1973 | Ikeda et al. | 204/38 E |
| 3,785,946 | 1/1974 | Terai et al. | 204/181 |
| 3,798,143 | 3/1974 | Rolles et al. | 204/181 |
| 3,799,848 | 3/1974 | Kolic et al. | 204/38 E |
| 3,834,999 | 9/1974 | Hradcovsky et al. | 204/56 R |
| 3,836,437 | 9/1974 | Osada et al. | 204/17 |

*Primary Examiner*—Howard S. Williams
*Assistant Examiner*—Aaron Weisstuch
*Attorney, Agent, or Firm*—Larson, Taylor and Hinds

[57] ABSTRACT

A process for coating an aluminum or aluminum alloy comprising the steps of subjecting the aluminum or aluminum alloy to boehmite treatment or chemical conversion treatment, anodizing the resulting aluminum or aluminum alloy in an aqueous solution of a water-soluble salt of at least one oxyacid, and thereafter coating the aluminum or aluminum alloy with an organic coating composition to form a resin layer, said oxyacid being at least one oxyacid selected from the group consisting of silicic acid, boric acid, phosphoric acid, molybdic acid, vanadic acid, permanganic acid, stannic acid and tungstic acid.

18 Claims, No Drawings

PROCESS FOR COATING ALUMINUM OR ALUMINUM ALLOY

This invention relates to a process for coating aluminum or aluminum alloys more particularly to a process for coating with an organic composition aluminum or aluminum alloys which have been subjected to boehmite treatment or chemical conversion treatment.

It is impossible to coat aluminum or aluminum alloys directly with an organic coating composition due to their poor ability to adhere to the organic coating composition. Various improved processes have heretobefore been proposed, therefore. According to one of the proposed processes, aluminum or aluminum alloys are subjected to so-called boehmite treatment by contacting the same with hot water or steam containing or not containing ammonia or amines to form an aluminum oxide layer on it surface which layer is predominantly composed of $Al_2O_3.nH_2O$ wherein $n$ is usually an integer of 1 to 3 and the aluminum or aluminum alloy is thereafter coated with an organic coating composition. Although aluminum or aluminum alloys can be coated with the organic coating composition by this process, the adhesion between the organic coating and the aluminum oxide layer formed is still poor. Furthermore, the aluminum oxide layer produced by the boehmite treatment has a thickness of as small as about $1.0\mu$ and is insufficient in toughness and texture. Therefore, if the organic coating formed thereon should be marred for one cause or another, corrosion may possibly develop in the aluminum oxide coating from that portion.

Another process, so-called chemical conversion treatment, is also known in which aluminum or aluminum alloys are immersed in an aqueous solution of phosphate and/or chromate to form a chemical conversion layer thereon and an organic coating composition is thereafter applied onto the layer. However, this process also fails to assure good adhesion between the organic coating and the chemical conversion coating layer formed on aluminum or aluminum alloy. Moreover, the layer formed by chemical conversion is not satisfactory in its resistance to corrosion. Thus the process has drawbacks similar to those of the boehmite treatment described. Such drawbacks of these processes entail serious problems when aluminum or aluminum alloys are used for sash and external building materials.

An object of this invention is to provide a process for coating aluminum or aluminum alloys subjected to boehmite treatment or chemical conversion treatment with an organic coating composition with high adhesion.

Another object of this invention is to provide a process for coating capable of forming a highly corrosion-resistant coating on aluminum or aluminum alloys which have been subjected to boehmite treatment or chemical conversion treatment.

Other objects of this invention will become apparent from the following description.

These objects of this invention can be fulfilled by a process comprising the steps of subjecting aluminum or aluminum alloys to boehmite treatment or chemical conversion treatment, anodizing the treated aluminum or aluminum alloy in an aqueous solution of a water-soluble salt of at least one oxyacid selected from the group consisting of silicic acid, boric acid, phosphoric acid, vanadic acid, tungstic acid, permanganic acid, molybdic acid and stannic acid, washing the resulting aluminum or aluminum alloy with water and thereafter coating the aluminum or aluminum alloy with an organic coating composition.

Our researches have revealed the following results:

1. When aluminum or aluminum alloy is subjected to boehmite treatment or chemical conversion treatment, followed by anodization of the resulting aluminum or aluminum alloy in an aqueous solution of water-soluble salt of at least one of the above-specified oxyacids, the oxyacid anions resulting from the dissociation of the oxyacid salt in the aqueous solution are adsorbed by the surface of the aluminum or aluminum alloy, whereupon they release their charges to react with the boehmite layer or chemical conversion layer, thereby forming a new inorganic layer. Subsequently, when an organic coating composition is applied onto the new layer by a usual method, a coating film is formed on the new layer as firmly adhered thereto since the new surface layer has an exceedingly high ability to adhere to the organic coating composition.

2. As compared with the aluminum oxide layer produced only by the boehmite treatment or chemical conversion treatment, the new layer obtained as above has a considerably larger thickness, improved toughness and fine texture and is therefore much more resistant to corrosion than the aluminum oxide layer or chemical conversion layer alone. As a result, the new layer gives the metal substrate an improved ability to adhere to the organic coating composition and remarkably enhanced resistance to corrosion. Thus even if the organic coating film formed thereon should be marred for one cause or another, the greatly improved corrosion resistance of the new layer itself enables the coated aluminum or aluminum alloy to remain much more resistant to corrosion than the coated product prepared by boehmite treatment or chemical conversion treatment.

According to the present invention, it is essential to conduct electrolysis using aluminum or aluminum alloy, which has been subjected to boehmite or chemical conversion treatment, as the electrode in an aqueous solution of a water-soluble salt of at least one oxyacid selected from the group consisting of silicic acid, boric acid, phosphoric acid, permanganic acid, vanadic acid, tungstic acid, molybdic acid and stannic acid and to subsequently coat the resulting aluminum or aluminum alloy with an organic coating composition.

In practicing the process of this invention, the aluminum or aluminum alloy is first subjected to the usual pretreatment including degreasing and etching. Degreasing is conducted in the usual manner, for example, by immersing aluminum or aluminum alloy in an acid such as nitric or sulfuric acid at room temperature. Similarly, etching is conducted in the usual manner as by immersing the aluminum or aluminum alloy in an alkali solution at a temperature of about 20° to 80°C. The aluminum or aluminum alloy thus pretreated is then subjected to boehmite treatment or chemical conversion treatment which is carried out by a conventional method.

The boehmite treatmment is usually conducted by contacting the aluminum or aluminum alloy thus treated with hot water or steam containing or not containing ammonia or amines. Examples of the amines usable are monoethanolamine, diethanolamine, triethanolamine, dimethylethanolamine and like water-soluble amines. Generally, about 0.1 to 5 parts by weight of amine or ammonia are used per 100 parts by weight of water. Use of such amine or ammonia brings about the increase of thickness of aluminum oxide layer produced by the boehmite treatment. The aluminum or aluminum alloy is kept in contact with hot water or steam usually for about 5 to 60 minutes. The temperature of the hot water to be used is usually in the range of 65 to boiling point, preferably 80 to boiling point and that of steam in the range of 100° to 180°C, preferably 130° to 150°C. Such contact is effected by methods heretofore employed, for example, by immersion or spraying.

Generally, the chemical conversion treatment is conducted with a chromate or phosphate. Examples of the chemical conversion treatment with chromate are MBV method using sodium carbonate and sodium chromate, EW method using sodium carbonate, sodium chromate and sodium silicate, LW method using sodium carbonate, sodium chromate and sodium primary phosphate, Pylumin method using sodium carbonate, sodium chromate and basic chromium carbonate, Alrock method using sodium carbonate and potassium dichromate, Jirocka method using dilute nitric acid containing heavy metal or using a mixture of permanganic acid and hydrofluoric acid containing heavy metal, Pacz method using a mixture of sodium silicofluoride and ammonium nitrate which contains a nickel or cobalt salt, etc. Examples of the chemical conversion treatment with phosphate are a method using manganese dihydrogenphosphate and manganese silicofluoride, a method wherein acidic zinc phosphate, phosphoric acid and chromic acid are used, etc.

The aluminum or aluminum alloy thus subjected to boehmite or chemical conversion treatment is rinsed with water and then used as the electrode to conduct electrolysis in an aqueous solution of water-soluble salt of at least on oxyacid selected from the group consisting of silicic acid, boric acid, phosphoric acid, molybdic acid, vanadic acid, permanganic acid, tungstic acid and stannic acid.

The oxyacid salts to be used include various salts of the above oxyacids with monovalent to trivalent metals, ammonia or organic amines. The silicates include orthosilicates, meta-silicates and disilicates and like polysilicates. Examples thereof are sodium orthosilicate, potassium orthosilicate, lithium orthosilicate, sodium metasilicate, potassium metasilicate, lithium metasilicate, lithium pentasilicate, barium silicate, ammonium silicate, tetramethanol ammonium silicate, triethanol ammonium silicate, etc. The borates include metaborates, tetraborates, pentaborates, perborates, biborates, borate-hydrogen peroxide addition products and boroformates. Examples are lithium metaborate ($LiBO_2$), potassium metaborate ($KBO_2$), sodium metaborate ($NaBO_2$), ammonium metaborate, lithium tetraborate ($Li_2B_4O_7.5H_2O$), potassium tetraborate, sodium tetraborate, ammonium tetraborate [$(NH_4)_2B_4O_7.4H_2O$], calcium metaborate [$Ca(BO_2)_2.2H_2O$], sodium pentaborate ($Na_2B_{10}O_{16}.10H_2O$), sodium perborate ($NaBO_2.H_2O_2.3H_2O$), sodium borate-hydrogen peroxide addition product ($NaBO_2.H_2O_2$), sodium boroformate ($NaH_2BO_2.HCOOH.2H_2O$), ammonium biborate [$(NH_4)HB_4O_7.3H_2O$], etc.

The phosphates include orthophosphates, pyrophosphates and polymetaphosphates. Examples are potassium monobasic phosphate ($KH_2PO_4$), sodium pyrophosphate ($Na_4P_2O_7$), sodium metaphosphate ($NaPO_3$), aluminum hydrophosphate [$Al(H_2PO_4)_3$], etc. The vanadates include orthovanadates, metavanadates and pyrovanadates. Examples are lithium orthovanadate ($Li_3VO_4$), sodium orthovanadate ($Na_3VO_4$), lithium metavanadate ($LiVO_3.2H_2O$), sodium metavanadate ($NaVO_3$), potassium metavanadate ($KVO_3$), ammonium metavanadate ($NH_4VO_3$) or [$(NH_4)_4V_4O_{12}$], sodiuim pyrovanadate ($Na_2V_2O_7$), etc. The tungstates include orthotungstates, metatungstates, paratungstates, pentatungstates and heptatungstates. Also employable are phosphorus wolframates, borotungstates and like complex salts. Examples are lithium tungstate ($Li_2WO_4$), sodium tungstate ($Na_2WO_4.2H_2O$), potassium tungstate ($K_2WO_4$), barium tungstate ($BaWO_4$), calcium tungstate ($CaWO_4$), strontium tungstate ($SrWO_4$), sodium metatungstate ($Na_2W_4O_{13}$), potassium metatungstate ($K_2W_4O_{13}.8H_2O$), sodium paratungstate ($Na_6W_7O_{24}$), ammonium pentatungstate [$(NH_4)_4W_5O_{17}.5H_2O$], ammonium heptatungstate [$(NH_4)_6W_7O_{24}.66H_2O$], sodium phosphowolframate ($2Na_2O.P_2O_5.12WO_3.18H_2O$), barium borotungstate ($2BaO.B_2O_3.9WO_3.18H_2O$), etc. Examples of permanganates are lithium permanganate ($LiMnO_4$), sodium permanganate ($NaMnO_4.3H_2O$), potassium permanaganate ($KMnO_4$), ammonium permanganate [$(NH_4)MnO_4$], calcium permanganate [$Ca(MnO_4)_2.4H_2O$], barium permanganate [$Ba(MnO_4)_2$], magnesium permanganate [$M_g(MnO_4)_2.6H_2O$], strontium permanganate [$Sr(MnO_4)_2.3H_2O$], etc. The stannates include orthostannates and metastannates. Examples are potassium orthostannate ($K_2SnO_3.3H_2O$), lithium orthostannate ($Li_2SnO_3.3H_2O$), sodium orthostannate ($Na_2SnO_3.3H_2O$), magnesium stannate, calcium stannate, lead stannate, ammonium stannate, potassium metastannate ($K_2O.5SnO_2.4H_2O$), sodium metastannate ($Na_2O.5SnO_2.8H_2O$), etc. Examples of molybdates are orthomolybdates and metamolybdates. More specific examples are lithium molybdate ($Li_2MoO_4$), sodium molybdate ($Na_2MoO_4$), potassium molybdate ($K_2MoO_4$), ammonium molybdate [$(NH_4)_6Mo_7O_{24}.4H_2O$] triethylamine molybdate, etc.

Preferable among these oxyacid salts are those of alkali metals which generally have high water solubilities. Among the oxyacid salts enumerated above, silicates are preferable to use because they are economical and readily available. According to this invention these oxyacid salts are used singly or in admixture with one another.

The concentration of such oxyacid salt in its aqueous solution is usually about 0.1% by weight to saturation, preferably about 1.0% by weight to saturation, although variable with the kind of the oxyacid salt.

In the present invention, water-soluble salts of chromic acid can be used together with the above-mentioned oxyacid salts, whereby the anti-corrosive property of the resulting coating is further improved. Examples of the chromates are lithium chromate ($Li_2CrO_4.2H_2O$), sodium chromate ($Na_2CrO_4.10H_2O$), potassium chromate ($K_2CrO_4$), ammonium chromate [$(NH_4)_2CrO_4$], calcium chromate ($CaCrO_4.2H_2O$) and strontium chromate ($SrCrO_4$).

According to this invention, the electrolysis is conducted in a conventional manner. For example, the aluminum or aluminum alloy and another electroconductive material used as electrodes are immersed in aqueous solution of the above-specified oxyacid salt, and electric current is applied between the electrodes. The electric current may be either direct current or alternating current. When direct current is used, the aluminum or aluminum alloy is to be the anode and when alternating current is used, the aluminum or aluminum alloy can be used either as anode or as cathode. The advantageous range for the electric voltage is from 5 to 300 volts for direct current, or from 5 to 200 volts for alternating current. The electric current is applied for more than 5 seconds. The temperature of the electrolytic solution is usually in the range between the separating point of the salt of the oxyacid from the solution and the boiling point of the solution, preferably in the range of 20° to 60°C.

According to this invention, the electrolytic operation can be conducted repeatedly two or more times with an aqueous solution of the same oxyacid salt or with aqueous solutions of different oxyacid salts. For example, electrolysis is conducted with an aqueous solution of silicate and then with the same aqueous solution of silicate, or first with an aqueous solution of silicate and subsequently with an aqueous solution of another oxyacid salt. When repeatedly carried out, the electrolysis also gives the resulting aluminum or aluminum alloy product higher corrosion resistance than when it is conducted only once. Moreover, the electrolysis causes some water to undergo electrolysis to give off hydrogen gas in the form of bubbles. Consequently, the bubbling lowers the efficiency of the electrolytic operation. However, if the electrolysis is conducted repeatedly, the evolution of hydrogen gas is noticeably reduced as compared with the case wherein the electrolytic operation is conducted only once, assuring improved efficiency.

After the electrolysis, the aluminum or aluminum alloy is rinsed with water and dried, whereby a thick layer of higher hardness and finer texture is formed. According to this invention, the dried product may further be heated at a temperature of about 150° to 250°C when desired to thereby increase the hardness of the coating.

After this treatment, the aluminum or aluminum alloy is coated with an organic coating composition by a usual coating method such as immersion, brush, spray coating, electrophoretic coating, electrostatic coating or the like. Effectively usable as the organic coating composition are a liquid coating composition mainly comprising a binder resin and a liquid medium and containing the pigment and other additives as desired and a powder coating composition predominantly consisting of a binder resin and further containing the desired pigment and additives. Any of various binder resins can be used as the binder resin, their examples being drying oil, semi-drying oil, cellulose and various synthetic or natural resins. More specifically, examples of drying oil or semi-drying oil are linseed oil, tung oil, soybean oil, castor oil, etc. and examples of cellulose are nitrocellulose. Exemplary of synthetic or natural resin are alkyd resin, modified alkyd resin, phenolic resin, amino resin, unsaturated polyester resin, epoxy resin, modified epoxy resin, polyurethane, acrylic resin, polybutadiene, modified polybutadiene, rosin, modified rosin, etc. Examples of the liquid medium are water and various organic solvents. Pigments which are usable as desired are usual coloring pigments such as titanium dioxide, red iron oxide, carbon black, Phthalocyanine Blue and extender pigments such as talc, clay, calcium carbonate and like conventional pigments. Examples of other additives are plasticizer, drying agent, dispersant, wetting agent, defoaming agent and other known additives.

The organic coating composition is suitably selected in accordance with the coating method employed. For electrophoretic coating, for example, a liquid coating composition, especially aqueous coating composition is used which is prepared by dissolving or dispersing a water-soluble or water-dispersible binder resin in an aqueous medium. Specific examples of such water-soluble or water-dispersible binder resin are addition products of drying oils and $\alpha,\beta$-ethylenically unsaturated dibasic acids such as maleic acid, epoxy resin esterified with fatty acid and having carboxyl groups, alkyd resin having carboxyl groups, copolymer of vinyl monomer and acrylic or methacrylic acid, polyester having carboxyl groups, a reaction product of polybutadiene and $\alpha,\beta$-ethylenically unsaturated dibasic acid such as maleic acid, etc. Examples of the aqueous medium are usually water or a mixture of water and an organic solvent. Examples of the solvent are benzyl alcohol, n-butanol, butyl cellosolve, isopropyl cellosolve, methyl cellosolve, isopropanol, carbitol, ethanol, etc. The sold concentration of the electrophoretic coating composition is in the range of 1 to 20 weight percent, preferably 5 to 15 weight percent.

In the case where electrophoretic coating process is adopted, either liquid composition or powder composition can be used.

According to this invention, the organic coating composition is applied to the substrate by a known method as already enumerated.

The aluminum or aluminum alloy substrate thus coated with an organic coating composition is then dried or/and baked, whereby a coating film is obtained which has uniform hardness.

The process of this invention is applicable to various aluminum alloys such as Al-Si, Al-Mg, Al-Mn, Al-Si-Mg, etc. The aluminum or aluminum alloy to be treated by the present process is not limited to plate or panel but may be of various shapes.

The process of this invention will be described below in greater detail with reference to examples and comparison examples, in which the percentages and parts are all by weight unless otherwise specified. In the examples aluminum panels serving as substrates were prepared by the method stated below, and electrolytic operation and electrophoretic coating operation were conducted according to the procedures stated below.

Preparation of Substrate

A substrate was prepared by degreasing and etching an aluminum alloy panel measuring 70 mm in width, 150 mm in length and 2 mm in thickness (consisting of 98.0% aluminum, 0.45% Si, 0.55% Mg and 1% others; JIS H 4100) according to the following procedure given below:

a. Immersion of 10% solution of nitric acid at room temperature for 5 minutes.
b. Rinsing in water.
c. Immersion in 5% aqueous solution of caustic soda at 50°C for 5 minutes.
d. Rinsing in water.
e. Immersion in 10% aqueous solution of nitric acid at room temperature for 1 minute.
f. Rinsing in water.

Electrolytic Operation

Into a plastic container measuring 10 cm in width, 20 cm in length and 15 cm in depth was placed 2000 cc of a solution of an oxyacid salt. When direct current was supplied, the aluminum substrate serving as the anode and a mild steel plate serving as cathode were immersed in the solution as spaced apart from each other by 15 cm. When alternating current was applied, the aluminum subtrates as electrodes were immersed in the same manner as above. Electrolytic operation was conducted at a liquid temperature of 25°C by applying a specified voltage. The aluminum substrate was thereafter washed with water and then dried.

Electrophoretic Coating Operation

Into the same container as used in the abovementioned electrolytic operation was placed 2000 cc of electrophoretic coating composition and the aluminum substrate serving as anode and a mild steel plate as a cathode were immersed in the electrophoretic coating composition as spaced apart from each other by 15 cm. Electrophoretic coating operation was conducted at a liquid temperature of 25°C by applying direct current of a specified voltage. The aluminum substrate was thereafter washed with water and then dried.

The properties of the aluminum substrate obtained in Examples and Comparison Examples are determined by the following method.

1. Coating thickness

Measured by a high-frequency thickness meter.

2. Hardness

Leave a test panel to stand in a constant temperature and constant humidity chamber at a temperature of 20° ± 1°C and a humidity of 75% for 1 hour. Fully sharpen a pencil (trade mark "UNI", product of Mitsubishi Pencil Co., Ltd., Japan) by a pencil sharpener and then wear away the sharp pencil point to flatness. Firmly press the pencil against the coating surface of the test panel at an angle of 45° between the axis of the pencil and the coating surface and push the pencil forward at a constant speed of 3 cm/sec as positioned in this state. Repeat the same procedure 5 times with each of pencils having various hardness. The hardness of the coating is expressed in terms of the highest of the hardnesses of the pencils with which the coating remain unbroken at more than 4 strokes.

3. Cross-cut Erichsen test

After leaving a test panel to stand in a constant temperature and constant humidity chamber at a temperature of 20° ± 1°C and a humidity of 75% for 1 hour, make eleven parallel cuts, 1 mm apart, in the coating film up to the surface of aluminum alloy substrate, using a single-edged razor blade. Make a similar set of cuts at right angles to the first cut to form 100 squares. Using an Erichsen film tester, push out the test panel 5 mm and apply a piece of cellophane adhesive tape to the pushed out portion. Press the tape firmly from above and thereafter remove the tape rapidly. The evaluation is expressed by a fraction in which the denominator is the number of squares formed and the numerator is the number of squares left unremoved. Thus 100/100 indicates that the coating remain completely unremoved.

4. Impact Resistance

After leaving a test panel to stand in a constant temperature and constant humidity chamber at a temperature of 20°±1°C and a humidity of 75% for 1 hour, test the panel on a Du Pont impact tester (1-kg, ½ inch). Determine the largest height (cm) of the weight entailing no cracking in the coating.

5. Resistance to Boiling Water

Place deionized water into a beaker along with a boiling stone and heat to boiling. Boil a test panel for 3 hours in the water while keeping the panel spaced apart from the bottom of the beaker by 20 mm. Take out the test panel to check for any change in the coating such as discoloring, peeling, cracking or blistering. Furthermore after leaving the test panel to stand for 1 hour, conduct cross-cut Erichsen test in the same manner as above to evaluate the adhering ability.

6. Resistance to sulfurous acid

Into a glass container, place a 6% aqueous solution of sulfurous acid having a specific gravity of 1.03 and add deionized water to prepare a 1% aqueous solution of sulfurous acid. Immerse a test panel in the solution at 20°C for 72 hours and then take it out to check with the unaided eye for any change in the coating such as discoloring, peeling, cracking and blistering. In the same manner as above, conduct cross-cut Erichsen test to evaluate the adhering ability.

7. Alkali Resistance

Fill a glass container with a 5% aqueous solution of sodium hydroxide and immerse a test panel therein at 20°C for 72 hours. Then take out the test panel and inspect the surface with the unaided eye to check for any change in the coating such as peeling, pitting and blistering.

8. CASS test (Copper-Accelerated Acetic acid-Salt Spray Testing)

Conduct CASS test according to JIS H 8601 for 72 hours. Inspect the appearance of coating with the unaided eye.

EXAMPLE 1

To 65 parts of water-soluble acrylic resin (trade mark: "ARON 4002", product of Toagosei Chemical Industry Co., Ltd., Japan) were added 35 parts of water-soluble melamine resin (trade mark: "XM-1116", product of American Cyanamid Company, U.S.A.) and 900 parts of deionized water and the mixture was uniformly mixed together to obtain an aqueous solution. pH of the solution was adjusted at 8 by adding triethylamine to the solution.

An aluminum substrate prepared as described above was immersed in boiling deionized water for 5 minutes for boehmite treatment, then rinsed with water and subsequently immersed in 10 wt.% aqueous solution of sodium silicate ($Na_2O.2SiO_2$) to conduct electrolysis by using of direct current at the specified voltage for the specified period of time as listed in Table 1 below. The aluminum substrate was then electrophoretically coated with the above coating composition at voltage of 100 volts to obtain a coated panel. Various properties of the coated panel obtained are given in Table 1 below.

EXAMPLES 2 to 4

Aluminum substrates were treated in the same manner as in Example 1 except that electrolysis was conducted using specified current at the voltages and for periods of time listed in Table 1. The acid resistance of each of the aluminum substrates thus treated was measured with the result shown in Table 1.

COMPARISON EXAMPLE 1

Aluminum substrate was treated in the same manner as Example 1 except that electrolysis was not conducted.

COMPARISON EXAMPLES 2 AND 3

Aluminum substrates prepared as above were immersed in 10 wt.% aqueous solution of sodium silicate ($Na_2O.2SiO_2$) without conducting boehmite treatment, and electrolysis was carried out under the conditions listed in Table 1, and followed by electrophoretic coating by the same manner as in Example 1.

EXAMPLES 5 to 15

Aluminum substrates were treated in the same manner as in Example 1 except that 3 wt.% aqueous solution of oxyacid salts indicated in Table 2 were used in place of sodium silicate. The properties of each of the substrates thus treated was determined with the result shown in Table 2 and Table 3.

Table 1

| | Ex. 1 | Ex. 2 | Ex. 3 | Ex. 4 | Comp. Ex. 1 | Comp. Ex. 2 | Comp. Ex. 3 |
|---|---|---|---|---|---|---|---|
| Electrolysis conditions | | | | | | | |
| Current | D.C*1 | D.C | A.C*2 | A.C | D.C | D.C | A.C |
| Voltage (V) | 40 | 40 | 80 | 80 | — | 40 | 80 |
| Time (sec) | 120 | 600 | 120 | 600 | — | 120 | 600 |
| Coating thickness ($\mu$) | 16 | 17 | 15 | 16 | 15 | 17 | 17 |
| Hardness | 3H | 3H | 3H | 3H | 3H | 3H | 3H |
| Cross-cut test | 100/100 | 100/100 | 100/100 | 100/100 | 90/100 | 100/100 | 100/100 |
| Impact resistance (cm) | 50 | 50 | 50 | 50 | 40 | 50 | 50 |
| Resistance to boiling water | | | | | | | |
| Appearance | Good | Good | Good | Good | Good | Partially peeling | Partially peeling |
| Adhering ability | 100/100 | 100/100 | 100/100 | 100/100 | 50/100 | 0/100 | 0/100 |
| Resistance to sulfurous acid | | | | | | | |
| Appearance | Good | Good | Good | Good | Good | Blistering | Blistering |
| Adhering ability | 100/100 | 100/100 | 100/100 | 100/100 | 50/100 | 0/100 | 0/100 |
| Alkali resistance | Good | Good | Good | Good | Good | Peeling | Peeling |
| CASS Test (Rating No.) | 10 | 10 | 10 | 10 | 9.5 | 8 | 8.5 |

Note:
*1Direct current.
*2Alternating current.

Table 2

| | Ex. 5 | Ex. 6 | Ex. 7 | Ex. 8 | Ex. 9 | Ex. 10 |
|---|---|---|---|---|---|---|
| Oxyacid salt | $KBO_2$ | $NaPO_3$ | $Al(H_2PO_4)_3$ | $Na_3VO_4$ | $NH_4VO_3$ | $K_2WO_4$ |
| Coating thickness ($\mu$) | 15 | 15 | 15 | 14 | 15 | 15 |
| Hardness | 3H | 3H | 3H | 3H | 3H | 3H |
| Cross-cut test | 100/100 | 100/100 | 100/100 | 100/100 | 100/100 | 100/100 |
| Impact resistance (cm) | 50 | 50 | 50 | 50 | 50 | 50 |
| Resistance to boiling water | | | | | | |
| Appearance | Good | Good | Good | Good | Good | Good |
| Adhering ability | 100/100 | 100/100 | 100/100 | 100/100 | 100/100 | 100/100 |
| Resistance to sulfurous acid | | | | | | |
| Appearance | Good | Good | Good | Good | Good | Good |
| Adhering ability | 100/100 | 100/100 | 100/100 | 100/100 | 100/100 | 100/100 |
| Alkali resistance | Good | Good | Good | Good | Good | Good |
| CASS test (Rating No.) | 10 | 10 | 9.5 | 10 | 10 | 10 |

Table 3

| | Ex.11 | Ex.12 | Ex.13 | Ex.14 | Ex.15 |
|---|---|---|---|---|---|
| Oxyacid salt | $Na_2W_4O_{13}$ | $KMnO_4$ | $Ba(MnO_4)_2$ | $K_2SnO_3.3H_2O$ | $K_2MoO_4$ |
| Coating thickness ($\mu$) | 16 | 14 | 15 | 15 | 16 |
| Hardness | 3H | 4H | 3H | 3H | 4H |
| Cross-cut test | 100/100 | 100/100 | 100/100 | 100/100 | 100/100 |
| Impact resistance (cm) | 50 | 50 | 50 | 50 | 50 |
| Resistance to boiling water | | | | | |
| Appearance | Good | Good | Good | Good | Good |
| Adhering ability | 100/100 | 100/100 | 100/100 | 100/100 | 95/100 |
| Resistance to sulfurous acid | | | | | |
| Appearance | Good | Good | Good | Good | Good |
| Adhering ability | 100/100 | 100/100 | 100/100 | 100/100 | 100/100 |
| Alkali resistance | Good | Good | Good | Good | Good |
| CASS test (Rating No.) | 10 | 10 | 10 | 10 | 10 |

Table 3-continued

| | Ex.11 | Ex.12 | Ex.13 | Ex.14 | Ex.15 |
|---|---|---|---|---|---|

EXAMPLE 16

An aluminum substrate prepared as described above was immersed in aqueous solution containing 1.5 parts of sodium chromate ($Na_2CrO_4$), 3 parts of sodium carbonate ($Na_2CO_3$) and 100 parts of water for 3 minutes at 50°C for chemical conversion coating, then rinsed with water and subsequently conducted to electrolysis by the same manner as in Example 1. The aluminum substrate was then electrophoretically coated by the same manner as in Example 1 to obtain a coated panel.

EXAMPLES 17 to 24

Aluminum substrates were treated in the same manner as in Example 16 except that 3 wt.% aqueous solution of oxyacid salts indicated in Table 4 or 5 were used in place of sodium silicate.

COMPARISON EXAMPLE 4

Aluminum substrate was treated in the same manner as in Example 16 except that electrolysis was not conducted.

The properties of each of the substrates obtained in Examples 16 to 24 and Comparison Example 4 was determined with the result shown in Table 4 or 5.

EXAMPLE 25

Aluminum substrate was treated in the same manner as in Example 1 except for electrophoretic coating operation. The aluminum substrate thus prepared was air-sprayed at air pressure of 3.5 kg/cm$^2$ with acrylic resin-modified polyurethane coating composition (trade mark: "Retan Clear No. 702", product of Kansai Paint Co., Ltd., Japan) and thereafter baked in a hot air at 80°C for 20 minutes.

EXAMPLE 26

Aluminum substrate was treated in the same manner as in Example 25 except that chemical conversion treatment was used in place of boehmite treatment.

EXAMPLE 27

Aluminum substrate was treated in the same manner as in Example 25 except that electrostatic spray-coating was conducted in place of air-spraying as follows:

Aluminum substrate to be coated was earthed positively and the same acrylic resin-modified polyurethane coating composition as in Example 25 was charged negatively at −90 KV. Coating was conducted by using "A-E-H Gun".

Table 4

| | Ex. 16 | Ex. 17 | Ex. 18 | Ex. 19 | Ex. 20 |
|---|---|---|---|---|---|
| Oxyacid salt | $Na_2O.2SiO_2$ | $K_2O.3SiO_2$ | $KBO_2$ | $KH_2PO_4$ | $Na_3VO_3$ |
| Coating thickness (μ) | 14 | 15 | 15 | 16 | 16 |
| Hardness | 3H | 3H | 3H | 3H | 3H |
| Cross-cut test | 100/100 | 100/100 | 100/100 | 100/100 | 100/100 |
| Impact resistance (cm) | 50 | 50 | 50 | 50 | 50 |
| Resistance to boiling water | | | | | |
| Appearance | Good | Good | Good | Good | Good |
| Adhering ability | 100/100 | 100/100 | 100/100 | 100/100 | 100/100 |
| Resistance to sulfurous acid | | | | | |
| Appearance | Good | Good | Good | Good | Good |
| Adhering ability | 100/100 | 100/100 | 100/100 | 100/100 | 100/100 |
| Alkali resistance | Good | Good | Good | Good | Good |
| CASS test (Rating No.) | 10 | 10 | 10 | 10 | 10 |

TABLE 5

| | Ex. 21 | Ex. 22 | Ex. 23 | Ex. 24 | Comp. Ex.4 |
|---|---|---|---|---|---|
| Oxyacid salt | $K_2WO_4$ | $KMnO_4$ | $K_2SnO_3.3H_2O$ | $K_2MoO_4$ | — |
| Coating thickness (μ) | 15 | 14 | 13 | 15 | 15 |
| Hardness | 3H | 3H | 3H | 3H | 2H |
| Cross-cut test | 100/100 | 100/100 | 100/100 | 100/100 | 100/100 |
| Impact resistance (cm) | 50 | 50 | 50 | 50 | 50 |
| Resistance to boiling water | | | | | |
| Appearance | Good | Good | Good | Good | Good |
| Adhering ability | 100/100 | 100/100 | 100/100 | 100/100 | 100/100 |
| Resistance to sulfurous acid | | | | | |
| Appearance | Good | Good | Good | Good | Blistening |
| Adhering ability | 100/100 | 100/100 | 100/100 | 100/100 | 50/100 |
| Alkali resistance | Good | Good | Good | Good | A few pitting |
| CASS test (Rating No.) | 10 | 10 | 10 | 10 | 9 |

EXAMPLE 28

Aluminum substrate was treated in the same manner as in Example 26 except that electrostatic spray-coating was used in place of air-spraying.

The properties of each of the substrates obtained in Examples 25 to 28 were determined with the result shown in Table 6.

Table 6

| | Ex. 25 | Ex. 26 | Ex. 27 | Ex. 28 |
|---|---|---|---|---|
| Oxyacid salt | $Na_2O.2SiO_2$ | $Na_2O.2SiO_2$ | $Na_2O.2SiO_2$ | $Na_2O.2SiO_2$ |
| Coating thickness ($\mu$) | 15 | 15 | 15 | 15 |
| Hardness | 3H | 3H | 3H | 3H |
| Cross-cut test | 100/100 | 100/100 | 100/100 | 100/100 |
| Impact resistance (cm) | 50 | 50 | 50 | 50 |
| Resistance to boiling water | | | | |
| Appearance | Good | Good | Good | Good |
| Adhering ability | 100/100 | 100/100 | 100/100 | 100/100 |
| Resistance to sulfurous acid | | | | |
| Appearance | Good | Good | Good | Good |
| Adhering ability | 100/100 | 100/100 | 100/100 | 100/100 |
| Alkali resistance | Good | Good | Good | Good |
| CASS test (Rating No.) | 10 | 10 | 10 | 10 |

EXAMPLE 29

Aluminum substrate was treated in the same manner as in Example 1 without electrophoretic coating. The aluminum substrate thus treated was then immersed in water-soluble acrylic resin modified polyester coating composition having a solid content of 17% by weight (trade mark: "Alguard No.1000", product of Kansai Paint Co., Ltd., Japan) and kept for 1 minute, and thereafter taken up at a speed of 1 m per minute. The resulting aluminum substrate was baked at 200°C for 15 minutes.

EXAMPLE 30

Aluminum substrate was treated in the same manner as in Example 29 except that chemical conversion treatment was used in place of boehmite treatment.

The properties of each of the substrates obtained in Example 29 and 30 were determined with the result shown in Table 7.

Table 7

| | Example 29 | Example 30 |
|---|---|---|
| Oxyacid salt | $Na_2O.2SiO_2$ | $Na_2O.2SiO_2$ |
| Coating thickness ($\mu$) | 15 | 16 |
| Hardness | 3H | 3H |
| Cross-cut test | 100/100 | 100/100 |
| Impact resistance (cm) | 50 | 50 |
| Resistance to boiling water | | |
| Appearance | Good | Good |
| Adhering ability | 100/100 | 100/100 |
| Resistance to sulfurous acid | | |
| Appearance | Good | Good |
| Adhering ability | 100/100 | 100/100 |
| Alkali resistance | Good | Good |
| CASS test (Rating No.) | 10 | 10 |

EXAMPLE 31

An aluminum substrate prepared as described previously was immersed in boiling deionized water for 10 minutes, then rinsed with water and subsequently immersed in an aqueous solution of sodium silicate ($Na_2O.2SiO_2$) to conduct electrolysis by applying direct current at 30 volts for 60 seconds. After rinsing with water, the substrate was immersed in 3% aqueous solution of sodium metaborate ($Na_2BO_2$) to conduct electrolysis by applying direct current at 60 volts for 60 seconds. The substrate was then rinsed with water and thereafter dried. The dried substrate was then conducted to electrophoretic coating by the same manner as in Example 1.

EXAMPLE 32

Aluminum substrate was treated in the same manner as in Example 1 except that two kinds of oxyacid salts indicated in Table 8 were used in place of sodium silicate.

Table 8

| | Example 31 | Example 32 |
|---|---|---|
| Oxyacid salt | $Na_2O.2SiO_2$<br>$Na_2BO_2$ | $Li_2O.10SiO_2$<br>$Na_2MoO_4$ |
| Coating thickness ($\mu$) | 16 | 15 |
| Hardness | 3H | 3H |
| Cross-cut test | 100/100 | 100/100 |
| Impact resistance (cm) | 50 | 50 |
| Resistance to boiling water | | |
| Appearance | Good | Good |
| Adhering ability | 100/100 | 100/100 |
| Resistance to sulfurous acid | | |
| Appearance | Good | Good |
| Adhering ability | 100/100 | 100/100 |
| Alkali resistance | Good | Good |
| CASS test (Rating No.) | 10 | 10 |

What we claim is:

1. A process for coating an aluminum or aluminum alloy comprising the steps of subjecting the aluminum or aluminum alloy to treatment with steam or hot water to form a boehmite layer or to chemical conversion treatment with at least one of phosphate and chromate, electrolytically anodizing the resulting aluminum or aluminum alloy in an aqueous solution of a water-soluble salt of at least one oxyacid, and thereafter coating the aluminum or aluminum alloy with an organic coating composition to form a resin layer, said oxyacid being at least one oxyacid selected from the group consisting of silicic acid, phosphoric acid, molybdic acid, vanadic acid, permanganic acid, stannic acid and tungstic acid.

2. The process for coating an aluminum or aluminum alloy according to claim 1, in which the aluminum or aluminum alloy is subjected to treatment with steam or hot water to form a boehmite layer.

3. The process for coating an aluminum or aluminum alloy according to claim 1, in which the aluminum or aluminum alloy is subjected to chemical conversion treatment with at least one of phosphate and chromate.

4. The process for coating an aluminum or aluminum alloy according to claim 1, in which the concentration of said water-soluble salt in the aqueous solution is in the range of 0.1 weight percent to saturation.

5. The process for coating an aluminum or aluminum alloy according to claim 4, in which said concentration is in the range of 1.0 weight percent to saturation.

6. The process for coating an aluminum or aluminum alloy according to claim 1, in which said water-soluble salt is at least one water-soluble salt of silicic acid.

7. The process for coating an aluminum or aluminum alloy according to claim 1, in which said water-soluble salt is at least one water-soluble salt of tungstic acid.

8. The process for coating an aluminum or aluminum alloy according to claim 1, in which said water-soluble salt is at least one water-soluble salt of phosphoric acid.

9. The process for coating an aluminum or aluminum alloy according to claim 1, in which said water-soluble salt is at least one water-soluble salt of molybdic acid.

10. The process for coating an aluminum or aluminum alloy according to claim 1, in which said water-soluble salt is at least one water-soluble salt of vanadic acid.

11. The process for coating an aluminum or aluminum alloy according to claim 1, in which said water-soluble salt is at least one water-soluble salt of permanganic acid.

12. The process for coating an aluminum or aluminum alloy according to claim 1, in which said water-soluble salt is at least one water-soluble salt of stannic acid.

13. The process for coating an aluminum or aluminum alloy according to claim 1, in which the aluminum or aluminum alloy is electrophoretically coated with an organic coating composition.

14. The process for coating an aluminum or aluminum alloy according to claim 1, in which the organic composition is electrostatically coated on the aluminum or aluminum alloy.

15. The process for coating an aluminum or aluminum alloy according to claim 1, in which the aluminum or aluminum alloy is coated by electrostatic spray coating method with an organic coating composition.

16. The process for coating an aluminum or aluminum alloy according to claim 1, in which the aluminum or aluminum alloy is coated by spray-coating method with an organic coating composition.

17. The process for coating an aluminum or aluminum alloy according to claim 1, in which the organic composition is coated on the aluminum or aluminum alloy by immersion-coating.

18. An aluminum or aluminum alloy coated by the method claimed in claim 1.

* * * * *